US005522709A

United States Patent [19]

Rhoades

[11] Patent Number: 5,522,709

[45] Date of Patent: Jun. 4, 1996

[54] APPARATUS FOR INTERMITTENT TRANSFER OF FLUID HAVING VAPOR TRAP SEAL AND VAPOR ESCAPE MEANS

[75] Inventor: George D. Rhoades, LaGrange, Ill.

[73] Assignee: Liquid Carbonic Corporation, Oak Brook, Ill.

[21] Appl. No.: 462,813

[22] Filed: Jun. 5, 1995

Related U.S. Application Data

[62] Division of Ser. No. 110,554, Aug. 23, 1993, Pat. No. 5,431,546.

[51] Int. Cl.[6] ..... F04B 17/00; F04B 53/06

[52] U.S. Cl. ..... 417/313; 417/420; 417/901; 417/421; 62/50.5; 62/50.6; 418/102; 418/259

[58] Field of Search ..... 417/313, 420, 417/421, 901; 62/50.1, 50.4, 50.5, 50.6; 418/259, 102

[56] References Cited

U.S. PATENT DOCUMENTS

| | | | |
|---|---|---|---|
| 2,291,138 | 7/1942 | Blom . | |
| 2,447,741 | 8/1948 | De Baufre . | |
| 2,518,597 | 8/1950 | Brooks . | |
| 3,091,183 | 5/1963 | Nahrgang . | |
| 3,157,128 | 11/1964 | Hustinx . | |
| 3,238,884 | 3/1966 | Wright | 417/420 |
| 3,238,891 | 3/1966 | Thier et al. . | |
| 3,323,465 | 6/1967 | Stillebroer . | |
| 3,379,132 | 4/1968 | Wagner . | |
| 4,418,544 | 12/1983 | Heybutzki et al. . | |
| 4,684,333 | 8/1987 | Hirakawa et al. . | |
| 5,242,285 | 9/1993 | Westermann, Jr. . | |
| 5,315,831 | 5/1994 | Goode et al. . | |

FOREIGN PATENT DOCUMENTS

| | | | |
|---|---|---|---|
| 191743 | 9/1957 | Austria . | |
| 906008 | 12/1945 | France . | |
| 2030455 | 12/1971 | Germany | 417/420 |
| 62990 | 4/1982 | Japan | 417/420 |
| 128489 | 8/1983 | Japan | 417/420 |
| 108573 | 6/1985 | Japan . | |

OTHER PUBLICATIONS

Liquid Carbonic Cryogenic Pumping System, 1967.

Mark's Standard Handbook for Mechanical Engineers, Eighth Edition, pp. 14–10 through 14–30 (McGraw–Hill, Inc., 1978).

Perry's Chemical Engineers' Handbook, Sixth Edition, *Pumping of Liquids and Gases,* pp. 6–4 through 6–10 (McGraw–Hill, Inc., 1984).

Elliott F. Wright; McGraw–Hill Encyclopedia of Science & Technology, Sixth Edition, *Centrifugal Pump,* vol. 3, pp. 390–392 (McGraw–Hill, Inc., 1987).

Elliott F. Wright; McGraw–Hill Encyclopedia of Science & Technology, Sixth Edition, *Displacement Pump,* vol. 5, pp. 358–360 (McGraw–Hill, Inc., 1987).

*Primary Examiner*—Richard A. Bertsch
*Assistant Examiner*—Roland G. McAndrews, Jr.
*Attorney, Agent, or Firm*—Fitch, Even, Tabin & Flannery

[57] ABSTRACT

Fluid transfer apparatus comprising a fluid reservoir and a pump connected to the reservoir by a supply line, wherein the apparatus is configured so that vapor generated in the pump during periods of inoperation may escape from the pump cavity through the pump inlet, rather than being trapped in the pump cavity, and liquid may flow into the pump cavity from the supply line through the pump inlet to replace escaping vapor, thereby providing reliable pump start-up during intermittent operation. The apparatus may be employed to pump LNG for fueling of vehicles. Where LNG or another cryogenic fluid is being pumped, the pump is preferably driven by a motor located above the pump and connected thereto by an elongated shaft. Shaft seals may be provided to prevent the fluid being pumped from contacting the motor or the bearings supporting the motor shaft. A vapor trap may be provided beneath the shaft seals to prevent contact between liquid being pumped and the shaft seals.

5 Claims, 5 Drawing Sheets

184
240
286
282
290
294
190
241
290a
288
176
238
186
236
238
308
200
257
192
220
204
202
213
204
5
222
212
220
5
193
180
189
210
194
214
178

APPARATUS FOR INTERMITTENT TRANSFER OF FLUID HAVING VAPOR TRAP SEAL AND VAPOR ESCAPE MEANS

This is a division of application Ser. No. 08/110,554, filed Aug. 23, 1993, which is now U.S. Pat. No. 5,431,546.

BACKGROUND OF THE INVENTION

The invention relates to apparatus for transferring fluid, and more particularly to a fluid transfer system which includes a pump that can be operated intermittently without priming.

In many pumping applications, the pump does not remain flooded during periods of nonuse. In many applications, starting the pump requires priming, bleeding of lines, or other steps to flood the pump and initiate flow of liquid therethrough. Steps such as priming often require manual intervention by a skilled operator.

One context in which the problem arises is in the use of liquid natural gas (LNG) as a fuel for motor vehicles. LNG is maintained typically at a temperature of about −250° F. to −260° F., and is typically maintained at equilibrium with its vapor in an insulated pressure vessel. For convenience in providing LNG fuel to vehicles, it may be desirable for the pump to be in an exposed, above-ground outdoor location which cannot efficiently be maintained at temperatures below the boiling point of the LNG while the pump is not in use. Centrifugal pumps have been found to be well suited for pumping of LNG, but require priming or other steps for start up when filled with vapor following a period of nonuse. In the context of fueling motor vehicles, it may be desirable for the pump to be usable by persons not particularly trained in start-up or other aspects of pump operation.

One method of avoiding pump start-up problems is to operate the pump continuously, controlling fluid flow through appropriate valving so that liquid may be dispensed on demand, and recirculated at other times. However, considerations such as energy efficiency and control of pump wear militate in favor of operating the pump only in response to a demand for transfer of fluid.

A general object of the invention is to provide a pump suitable for use in pumping fluids such as LNG on demand, without requiring continuous operation of the pump, and without requiring the services of a skilled technician to prime the pump, bleed vapor from lines, or otherwise take manual steps to flood the pump after a period of inoperation.

Among the problems which must be addressed in providing a fluid transfer system in this context are the effect of the low temperature liquid on pump components, both during normal operation and as a consequence of leakage. Cryogenic fluids tend to increase viscosity of conventional lubricants often used in pumps, leading to accelerated wear and other problems. It is an object of the invention to address the problems associated with handling cryogenic fluids such as LNG in pumping such fluids.

SUMMARY OF THE INVENTION

The invention provides fluid transfer apparatus for providing reliable start-up without priming during intermittent operation, comprising a fluid reservoir and a pump connected to the reservoir by a supply line, wherein the apparatus is configured so that vapor generated in the pump during periods of inoperation may escape from the pump cavity through the pump inlet rather than being trapped in the pump cavity, and liquid may flow into the pump cavity from the supply line through the pump inlet to replace escaping vapor.

To permit the vapor to escape through the inlet, the upper surfaces of the pump cavity may be sloped towards the inlet, or may be substantially horizontal. The means disposed in the cavity for pumping the fluid, e.g., a rotor or other component, also may have their upper surfaces appropriately configured to facilitate escape of vapor, and, to this end, may slope toward the inlet, or alternatively may be horizontal, but preferably do not have downwardly facing concavities which would trap vapor forming within the pump.

In accordance with a preferred embodiment of the invention, a liquid/vapor separator is connected to the supply line at a relatively elevated location on the supply line, so that vapor in the supply line may be separated from liquid and vented.

The system is preferably configured to isolate the motor and/or bearings from the effects of cryogenic fluids flowing through the pump, or leaking therefrom. Isolation of the motor and other components from the effects of cryogenic fluids may be provided by positioning the motor above the pumps and providing a vapor trap between the pump and the motor.

The invention may employ any one of various different types of pumps, such as centrifugal pumps, vane pumps, gear pumps, piston pumps, or other types of pumps which may be suitable for particular applications.

Vapor which escapes from the pump cavity into the intake line is preferably permitted to flow upward through the intake line to a separator where particles of liquid may be separated by gravity from the vapor. The separator is preferably connected to a vent line which returns vapor to the top of the fluid reservoir. The separator is preferably positioned above a relatively high point on the supply line so that vapor generated within the supply line flows into the separator, in addition to vapor generated in the pump cavity.

Further aspects of the invention will be apparent from the detailed description of preferred embodiments set forth below, taken in conjunction with the accompanying drawings.

DETAILED DESCRIPTION OF THE PREFERRED EMBODIMENT

Figure 3:
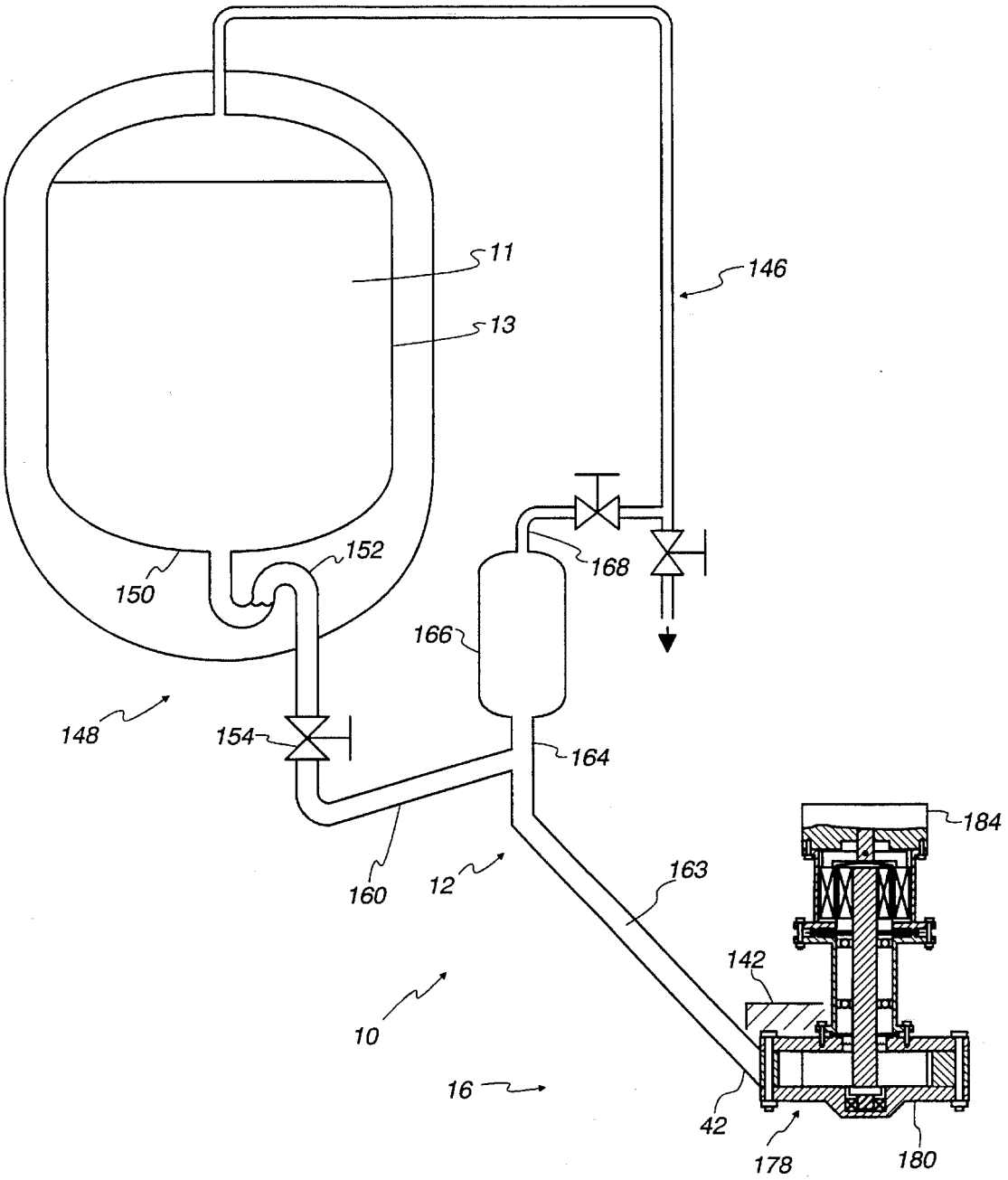
FIG. 3 is a schematic elevational view of the apparatus including the pump of FIG. 4.
Figure 4:
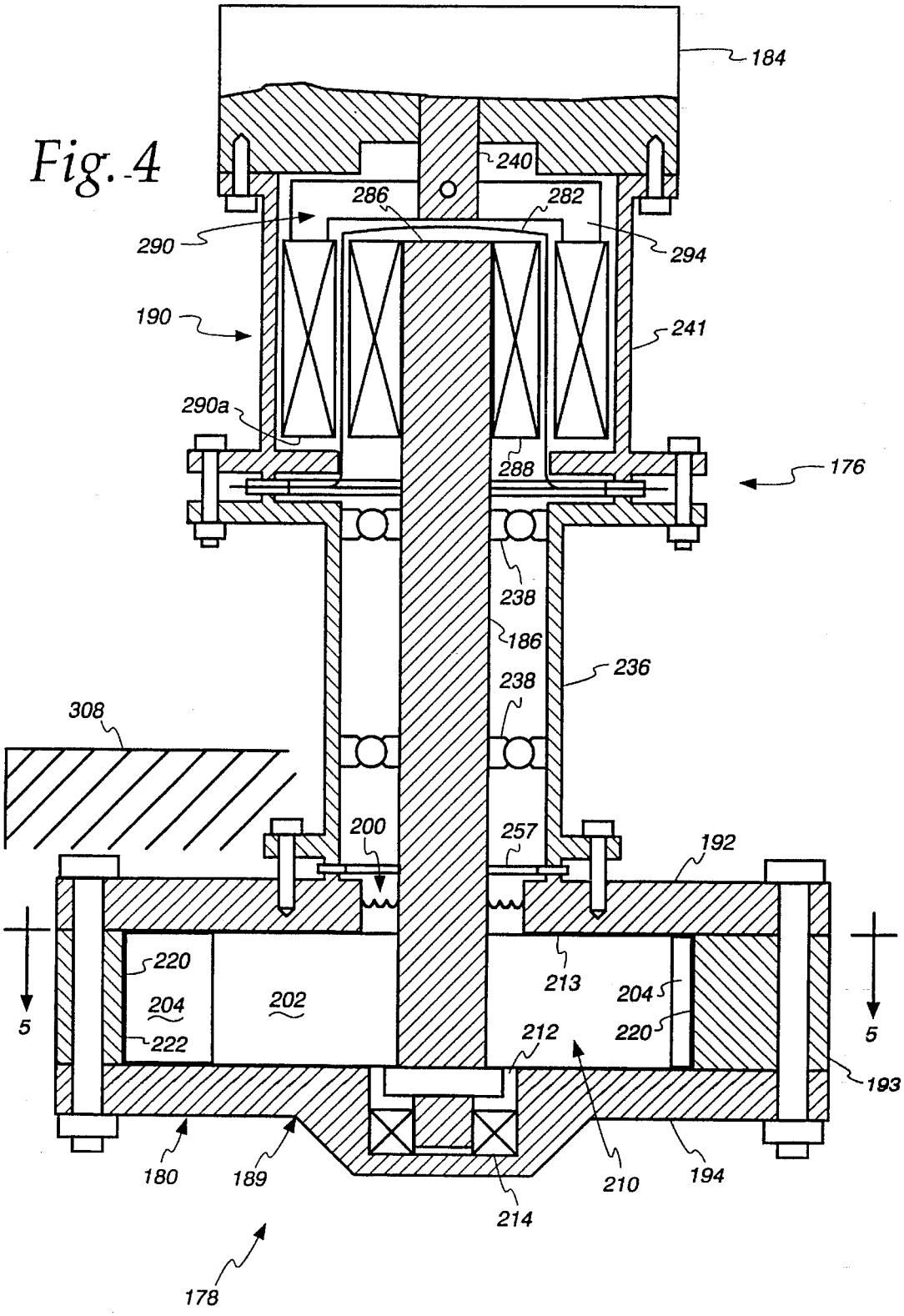
FIG. 4 is an elevational longitudinal sectional view of a pump and adjacent components in accordance with a second embodiment of the invention.
Figure 5:
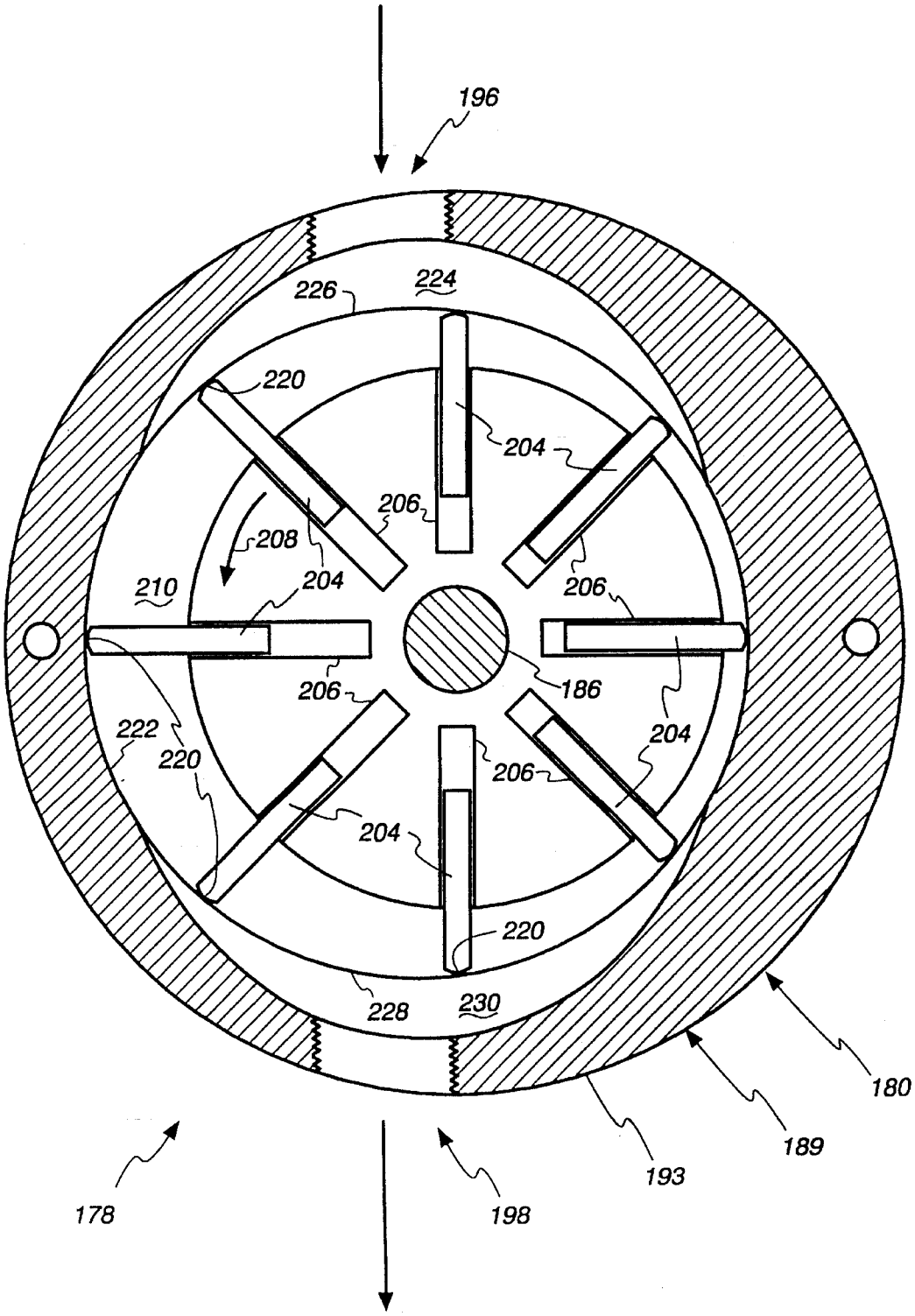
FIG. 5 is a cross-sectional view of the pump of FIG. 4, taken substantially along line 5—5 in FIG. 4.

The invention is preferably embodied in apparatus for intermittent transfer of fluids. For purposes of example, there is illustrated in FIGS. 3–5, apparatus 10 comprising a vessel 13 (FIG. 3) containing a fluid reservoir 11, a pump 180, and a fluid supply line 12 for carrying fluid from the vessel to the pump.

Figure 1:
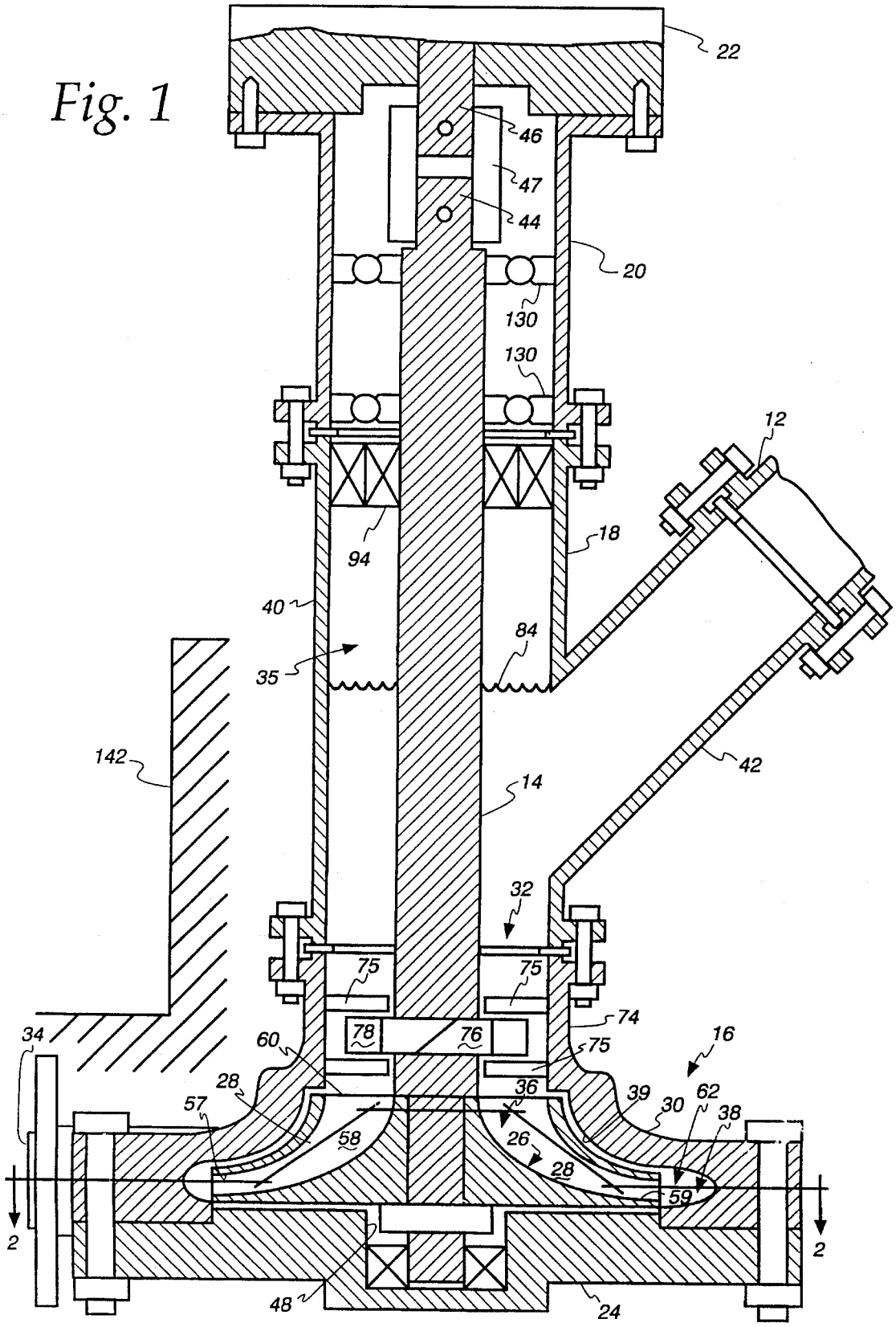
FIG. 1 is a partly diagrammatic elevational longitudinal sectional view of a pump and adjacent components in a fluid transfer apparatus in accordance with a first embodiment of the invention.
Figure 2:
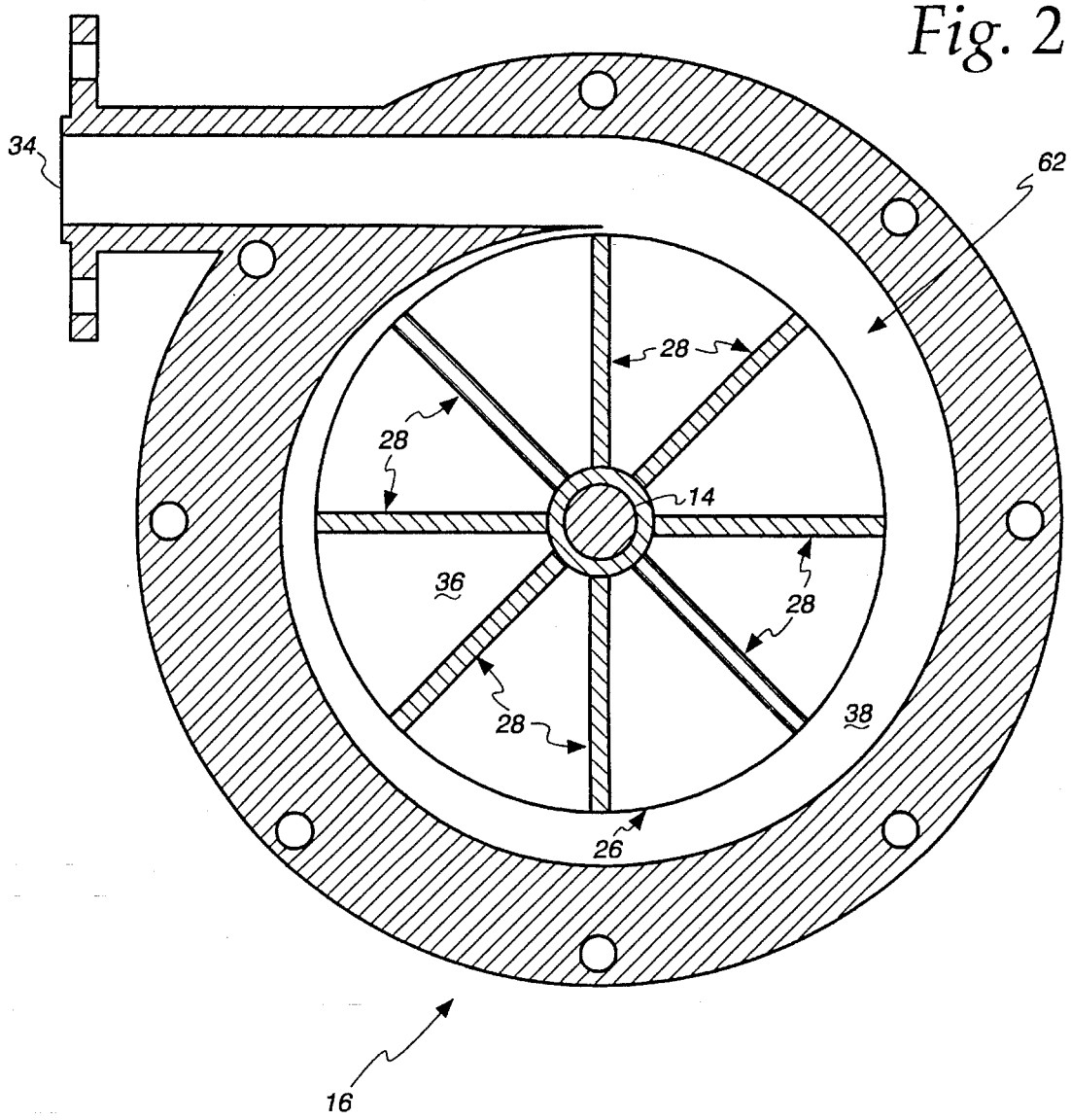
FIG. 2 is a cross-sectional view taken substantially along line 2—2 in FIG. 1.

The pump may be of conventional design, and may be, for example, a conventional centrifugal pump or as illustrated in FIGS. 1 and 2, or it may alternatively comprise a vane pump as described below in connection with FIGS. 3–5, a gear pump, a diaphragm pump, a piston pump, or other pump, selected to accommodate the requirements of particular applications.

The centrifugal pump 16 of FIGS. 1 and 2 generally comprises a rotary impeller 26 having a plurality of blades 28 disposed within a housing comprising a bottom plate 24 and a stationary volute casing 30 defining a cavity 62 in which the impeller 26 rotates. An inlet 32 is located above the impeller 26 for introducing the fluid to the pump cavity 62 and an outlet 34 is provided at the level of the impeller for discharge of fluid. The illustrated system may be employed for fueling of motor vehicles, in which case the outlet 34 discharges fluid to a nozzle for dispensing of fluid to vehicle fuel tanks. During operation, fluid flows downward into the pump cavity 62 as the impeller effects flow outward along the blades 28 from a central portion 36 of the cavity to an outer portion 38 thereof, and thence to the pump outlet 34. The pump is preferably driven by a motor 22. The motor and pump are connected by a shaft 14.

The illustrated system is particularly useful for handling cryogenic fluids such as LNG. However, the system may be useful for pumping of other fluids as well.

In accordance with a feature of the invention, the system enables the pump cavity to remain flooded during periods of nonuse, even when liquid within the pump cavity is evaporating. In the context of pumping a cryogenic fluid such as LNG in applications where the pump is not maintained below the boiling point of the fluid, this feature avoids the need for priming the pump following a period of nonuse.

To this end, in the embodiment of FIGS. 1 and 2, the upper surface 39 of the pump cavity slopes upward toward the inlet 32, and a bifurcated intake conduit 18 permits exchange of upwardly flowing vapor from the cavity with downwardly flowing liquid from the supply line 12. This enables vapor from the pump cavity 62 to flow upward through the inlet 32 into the supply line 12 as liquid from the supply line flows downward through the inlet to replace the escaping vapor.

The illustrated pump 16 is of a known, conventional design, but pumps of this design, so far as is known, have not been used in an orientation as illustrated, in combination with a bifurcated intake conduit 18 and other system components as described herein which enable the pump cavity 62 to remain flooded during static conditions, i.e., during periods of inoperation.

In addition to providing for escape of vapor from the pump cavity 62, the system illustrated in FIGS. 1–4 is configured to avoid detrimental cooling of the pump motor and bearings by the cryogenic fluid. To this end, the motor and bearings are preferably located above the pump to avoid the risk of leakage of fluid into the motor 22 and shaft bearings 130, and the bifurcated intake conduit is configured to cooperate with the shaft 14 and a seal assembly 94 to provide a vapor trap 35 between the pump and the bearings.

The vapor trap 35 provides sufficient spacing between the fluid and the seal 94 to prevent the fluid from contacting the seal 94 under normal circumstances. This enables the seal 94 to be a "warm seal" rather than requiring a "cold seal" capable of withstanding contact with cryogenic liquids.

In the illustrated embodiment, the pump 16 is oriented generally vertically, with the inlet 32 located above the impeller 26. In other embodiments, the pump 16 might be tilted rather than vertical.

Immediately above the pump 16, the shaft 14 is enclosed within one leg 40 of the bifurcated intake conduit 18 which extends vertically upward from the inlet 32 to the seal 94. The fluid supply line 12 feeds into the intake conduit 18 through a second, inclined leg 42, which in the illustrated embodiment extends upward at an angle of about 45°.

The pump shaft 14 is connected at its upper end 44 to the motor shaft 46 through a suitable coupling 47. The shaft 14 is made from material suitable for contact with cryogenic fluids. The bottom plate 24 of the pump has a centrally located recess 48 containing a bearing assembly 54 which receives the lower end of the shaft 14.

In the embodiment of FIGS. 1 and 2, the impeller 26 is a closed-type, or shrouded, single suction impeller having an impeller cavity 58 defined by a top or outer member 57 and a bottom or inner member 59 and a fluid entrance 60 at the top of the impeller cavity 58 about the shaft 14 below the pump inlet 32. While FIGS. 1 and 2 illustrate the blades 28 as extending substantially radially from the bottom or inner member 59 to the top or outer member 57, the blades may alternatively be curved to provide more efficient pump operation. In other embodiments, a different impeller configuration, such as an open or semi-open impeller, may be used.

In the illustrated embodiment, the volute casing 30 extends upward from the pump cavity 62 to form an annular neck 74 enclosing an inducer 76 with counter-spin blades 78 for increasing the fluid's velocity into the volute casing 30. The counter-spin blades 78 take the form of a spiral. To control flow within the neck 74, a plurality of vanes 75 project radially inward from the inner surface of the neck 74 at locations just above and below the inducer 76.

During periods of nonuse, as liquid in the pump cavity vaporizes, vapor bubbles upward through static liquid in the lower portion of the intake conduit 16 into the vapor trap 35. Excess vapor flows out through the inclined leg 42 of the intake conduit 16. This maintains the surface 84 of the liquid at the level of the uppermost point of the intersection of the interiors of the legs 40 and 42. Any loss of vapor from vapor trap 35 is replenished before vapor from the pump cavity flows out of the intake conduit through the inclined leg 42.

The shaft 14 is supported at its upper end by a pair of bearings 130 supported in a tubular housing 20.

As shown in FIG. 3, the supply line 12 generally comprises a first portion 148 which extends generally downward from the bottom 150 of the storage vessel 13, a vapor trap 152 to prevent liquid from flowing outward toward the warm surface of the vessel 13 through the supply line, a second, generally upwardly sloping portion 160, and a third, generally downwardly sloping portion 163. A suitable control valve 154 is provided downstream of the trap 152.

Vapor is removed from the supply line 12 by gravitational flow into a liquid/vapor separator, and thence through a vapor return system 146 comprising a return line 168 and suitable valving. The liquid/vapor separator is located above the juncture of the upwardly-sloping portion 160 and the downwardly-sloping portion 163 of the supply line 12 so that vapor generated in either portion of the supply line or in the pump flows under the influence of gravity toward the separator along the upper interior surface of the supply line, while liquid displacing the vapor may flow in the opposite direction along the bottom of the supply line. The separator 166 is connected to the supply line by a vertical or steeply sloped conduit 164 which at its lower end intersects the downwardly sloping portion 163 of the supply line 12. The upwardly sloping portion 160 of the supply line 12 intersects the vertical conduit 164 above the lower end thereof.

The separator 166 provides a relatively large interior space containing fluid flowing at low velocity or at zero velocity, so that liquid which enters the separator may collect at the bottom thereof and flow to the downwardly-sloping portion 163 of the supply line 12 through vertical conduit 164. A float valve (not shown) prevents the separator from filling with liquid. Vapor in the separator 166 flows through a return line 168 extending from the top of the separator 166 to enter the storage vessel 13 at or near the top thereof.

The pump 180 is preferably encased with insulation 142, and the supply line 12 and reservoir 11 are also preferably insulated.

FIGS. 4 and 5 illustrate a second embodiment of the invention comprising a transfer pump system 178. The system components illustrated in FIG. 4 generally comprise a positive displacement pump 180 and a motor 184 for driving the pump through a magnetic coupling device 190 and elongated shaft 186.

The illustrated pump 180 has a stationary housing 189 which comprises a top member 192, an intermediate member 193, and a bottom member 194, defining a pump cavity containing a rotor 202 fixed to the shaft 186. The shaft is supported at its lower end by a bearing 214 disposed in a recess 212 in the bottom member 194.

The pump 180 includes an inlet 196 located on one side of the housing 189 for introducing fluid into the pump 180, an outlet 198 located opposite the inlet 196 on the side of the housing 189 for discharging the fluid, and a vapor trap 200 centrally located above the rotor 202.

The rotor 202 comprises a plurality of moveable vanes 204 sliding in radial slots 206, and rotates counter-clockwise as indicated by arrow 208 in an eccentric pump cavity 210 defined by the inner surface 222 of the intermediate member 193.

As the rotor 202 rotates in operation, fluid flows from an inlet filling chamber 224 communicating with the inlet 196 through one or more inlet openings 226. The fluid discharges through one or more discharge openings 228 in the inner wall 222 into a discharge chamber 230 that communicates with the outlet 198.

To limit cooling of the motor 184 to undesirably low temperatures by cryogenic fluid flowing through the system, and to limit transfer of ambient heat to the fluid, the system employs an elongated shaft 186 contained within a two-piece housing 176, mechanically connected to the motor shaft by a magnetic coupling device 190.

The housing 176 comprises a lower housing 236 containing bearings 238 and an upper housing 241. A splash shield 257 extends-across the bottom of lower housing 236 to prevent or limit splash of liquid to the bearings 238.

To eliminate the need four a conventional mechanical shaft seal between the motor and the pump shaft 186, the pump shaft is not coupled to the motor shaft by a direct mechanical connection. The upper end 286 of the pump shaft 186 is disposed within a continuous seal 282 forming an upside-down, cup-shaped construction within the upper housing.

To transmit power from the motor shaft 240 to the pump shaft 186, a magnetic coupling device 190 provides an indirect mechanical connection between the upper end 286 of the pump shaft and the lower end of the motor shaft 240. The magnetic coupling comprises an inner driven rotor 288 disposed within the seal 282 and affixed to the shaft, and an outer drive rotor 290 disposed outside of the seal 282. The drive rotor 290 includes a bracket 294 which is attached to the motor shaft 240, and one or more magnets 290a mounted on the bracket 294. The driven rotor 288 similarly comprises one or more magnets 288 affixed to the pump shaft and magnetically coupled to the magnets 290*a* and 290*b* for rotation therewith. The entire pump end 178 is surrounded with insulation 308 to limit heating from the environment.

To enable vapor to escape from the pump cavity through the inlet 196, the upper surface 213 of the pump cavity 210 is generally horizontal as illustrated in FIG. 4. In this orientation, substantially all of the vapor generated within the pump during periods of inoperation will flow back out through the inlet 196. A small amount of vapor will remain in the vapor trap 200, and an additional small volume of vapor may be present adjacent the upper surface 213 of the cavity, but the volume of vapor remaining in these locations should not be so great as to prevent rapid, reliable pump start-up without priming. To reduce the amount of vapor that may remain adjacent the upper wall of the Cavity, the pump may be inclined slightly from the vertical, with the inlet 196 raised slightly relative to the outlet 198. This will facilitate flow of vapor out of the inlet in accordance with the invention.

From the foregoing it will be appreciated that the invention provides a novel and improved fluid transfer apparatus that is particularly well-suited for transfer of liquids having high vapor pressures at ambient temperatures. The invention is not limited to the embodiments described above. The invention may, for example, be embodied in a method or apparatus for transfer of fluid wherein a turbine pump or other pump is employed rather than the particular types of pumps described above and illustrated in the accompanying drawings. The invention is particularly pointed out by the following claims.

What is claimed is:

1. Fluid transfer apparatus for fueling of motor vehicles in intermittent operation comprising:

a vessel containing a cryogenic liquid to be transferred;

a pump comprising an inlet, an outlet, a housing defining a cavity and a positive displacement fluid mechanism comprising a rotor within said cavity for effecting flow of liquid from said cavity through said outlet; and a supply line carrying the cryogenic liquid from said vessel to said pump, and including a portion disposed at an elevation above that of said inlet and extending generally downward to said inlet;

said inlet being at an elevation below at least a portion of the liquid contained in said supply line;

said cavity having a substantially horizontal upper surface and being configured so that when said pump is not being operated, vapor generated in said cavity is displaced from said cavity to said inlet by fluid pressure and flows out of said cavity through said inlet rather than being trapped in said cavity during periods of inoperation, with liquid flowing into said cavity from said supply line through said inlet to replace escaping vapor so that said pump cavity remains flooded during interruptions of pump operation during which liquid is vaporized within said pump cavity;

a motor for driving said pump;

a shaft coupling connecting said motor to a pump shaft of said pump; and a structure defining a vapor trap about a portion of said shaft;

said motor being disposed above said pump;

said structure including a peripheral portion surrounding a portion of said shaft, and a seal extending between said peripheral portion of said structure and through said shaft;

said vapor trap maintaining a quantity of said vapor between said seal and the cryogenic liquid in the pump cavity so that said seal is normally in contact with vapor and not with the cryogenic liquid being transferred.

2. Fluid transfer apparatus in accordance with claim 1 further comprising a liquid/vapor separator connected to said supply line at a relatively elevated location upstream from said pump, said supply line having a portion sloping upward toward said separator immediately upstream thereof, and having a portion sloping downward from said separator immediately downstream thereof;

said liquid/vapor separator comprising an enclosed chamber for receiving fluid from said supply line, and permitting vapor in said fluid to separate from liquid in said fluid;

said apparatus further comprising means for venting vapor from said liquid/vapor separator.

3. Fluid transfer apparatus in accordance with claim 2 wherein said means for venting vapor from said liquid/vapor separator comprises a vapor line connecting said separator to said vessel to return vapor from said liquid/vapor separator to said vessel independently of said supply line.

4. Fluid transfer apparatus in accordance with claim 1 wherein said shaft coupling comprises a noncontacting magnetic coupling, said noncontacting magnetic coupling comprising a first member on said first portion of said shaft and a second portion on said second portion of said shaft, and a seal therebetween for preventing transmission of vapor thereacross.

5. Fluid transfer apparatus in accordance with claim 1 wherein said pump comprises a vane pump.

* * * * *

UNITED STATES PATENT AND TRADEMARK OFFICE

CERTIFICATE OF CORRECTION

PATENT NO. : 5,522,709

DATED : June 4, 1996

INVENTOR(S) : George D. RHOADES

It is certified that error appears in the above-indentified patent and that said Letters Patent is hereby corrected as shown below:

Column 7, line 5, after "shaft" insert --coupling--.

Column 8, line 15, change "a" to --said--.

Signed and Sealed this

First Day of October, 1996

Bruce Lehman

*Attest:*

BRUCE LEHMAN

*Attesting Officer*

*Commissioner of Patents and Trademarks*